US007594614B2

(12) United States Patent
Vijay et al.

(10) Patent No.: US 7,594,614 B2
(45) Date of Patent: Sep. 29, 2009

(54) ULTRASONIC WATERJET APPARATUS

(75) Inventors: Mohan M. Vijay, Gloucester (CA); Wenzhuo Yan, Ottawa (CA); Andrew Tieu, Ottawa (CA); Baolin Ren, Gatineau (CA)

(73) Assignee: VLN Advanced Technologies, Inc. (CA)

( * ) Notice: Subject to any disclaimer, the term of this patent is extended or adjusted under 35 U.S.C. 154(b) by 524 days.

(21) Appl. No.: 10/577,718

(22) PCT Filed: Nov. 3, 2003

(86) PCT No.: PCT/CA03/01683

§ 371 (c)(1),
(2), (4) Date: May 2, 2006

(87) PCT Pub. No.: WO2005/042177

PCT Pub. Date: May 12, 2005

(65) Prior Publication Data

US 2007/0063066 A1 Mar. 22, 2007

(51) Int. Cl.
*B05B 1/08* (2006.01)

(52) U.S. Cl. ..... 239/101; 239/99; 239/102.2; 239/127; 239/128; 239/251; 239/525; 239/722; 239/DIG. 4; 310/341

(58) Field of Classification Search ..... 239/4, 239/99, 101, 102.1, 102.2, 124, 127, 128, 239/172, 251, 525, 526, 589, 589.1, 722, 239/DIG. 4; 175/67, 424; 299/16, 17; 134/17, 134/34; 310/311, 328, 341
See application file for complete search history.

(56) References Cited

U.S. PATENT DOCUMENTS

| | | | | |
|---|---|---|---|---|
| 2,834,158 | A * | 5/1958 | Petermann | 239/102.2 |
| 3,373,752 | A * | 3/1968 | Kiyoshi | 239/4 |
| 4,185,706 | A * | 1/1980 | Baker et al. | 175/67 |
| 4,326,553 | A * | 4/1982 | Hall | 239/102.2 |
| 4,716,849 | A * | 1/1988 | Conn et al. | 299/17 |
| 4,821,961 | A | 4/1989 | Shook | |
| 5,020,724 | A * | 6/1991 | Kiyono et al. | 239/102.2 |

(Continued)

*Primary Examiner*—Steven J Ganey
(74) *Attorney, Agent, or Firm*—Buckingham, Doolittle, & Burroughs, LLP

(57) ABSTRACT

An ultrasonic waterjet apparatus (10) has a mobile generator module (20) and a high-pressure water hose (40) for delivering high-pressure water from the mobile generator module (20) to a hand-held gun (50) with a trigger and an ultrasonic nozzle (60). An ultrasonic generator in the mobile generator module (20) transmits high-frequency electrical pulses to a piezoelectric or magnetostrictive transducer (62) which vibrates to modulate a high-pressure waterjet flowing through the nozzle (60). The waterjet exiting the ultrasonic nozzle (60) is pulsed into mini slugs of water, each of which imparts a waterhammer pressure on a target surface. The ultrasonic waterjet apparatus (10) may be used to cut and de-burr materials, to clean and de-coat surfaces, and to break rocks. The ultrasonic waterjet apparatus (10) performs these tasks with much greater efficiency than conventional continuous-flow waterjet systems because of the repetitive waterhammer effect. A nozzle with multiple exit orifices or a rotating nozzle (76) may be provided in lieu of a nozzle with a single exit orifice to render cleaning and de-coating large surfaces more efficient. A water dump valve (27) and controlling solenoid are located in the mobile generator module (20) rather than the gun (50) to make the gun lighter and more ergonomic.

22 Claims, 13 Drawing Sheets

U.S. PATENT DOCUMENTS 5,154,347 A 10/1992 Vijay
5,217,163 A * 6/1993 Henshaw ..... 239/101
5,725,680 A 3/1998 Mathieus
6,424,078 B1 * 7/2002 Heinz ..... 310/328

* cited by examiner

ULTRASONIC WATERJET APPARATUS

This application is a 35 U.S.C. 371 of PCT/CA03/01683 filed Nov. 3, 2003.

TECHNICAL FIELD

The present invention relates, in general, to high-pressure waterjets for cleaning and cutting and, in particular, to high-frequency modulated waterjets.

BACKGROUND OF THE INVENTION

Continuous-flow high-pressure waterjets are well known in the art for cleaning and cutting applications. Depending on the particular application, the water pressure required to produce a high-pressure waterjet may be in the order of a few thousand pounds per square inch (psi) for fairly straightforward cleaning tasks to tens of thousands of pounds per square inch for cutting and removing hardened coatings.

Examples of continuous-flow, high-pressure waterjet systems for cutting and cleaning are disclosed in U.S. Pat. Nos. 4,787,178 (Morgan et al.), 4,966,059 (Landeck), 6,533,640 (Nopwaskey et al.), 5,584,016 (Varghese et al.), 5,778,713 (Butler et al.), 6,021,699 (Caspar), 6,126,524 (Shepherd) and 6,220,529 (Xu). Further examples are found in European Patent Applications EP 0 810 038 (Munoz) and EP 0 983 827 (Zumstein), as well as in US Patent Application Publications US 2002/0109017 (Rogers et al.), US 2002/0124868 (Rice et al.), and US 2002/0173220 (Lewin et al.).

Continuous-flow waterjet technology, of which the foregoing are examples, suffers from certain drawbacks which render continuous-flow waterjet systems expensive and cumbersome. As persons skilled in the art have come to appreciate, continuous-flow waterjet equipment must be robustly designed to withstand the extremely high water pressures involved. Consequently, the nozzle, water lines and fittings are bulky, heavy and expensive. To deliver an ultra-high-pressure waterjet, an expensive ultra-high-pressure water pump is required, which further increases costs both in terms of the capital cost of such a pump and the energy costs associated with running such a pump.

In response to the shortcomings of continuous-flow waterjets, an ultrasonically pulsating nozzle was developed to deliver high-frequency modulated water in non-continuous, virtually discrete packets, or "slugs". This ultrasonic nozzle is described and illustrated in detail in U.S. Pat. No. 5,134,347 (Vijay) which on Oct. 13, 1992. The ultrasonic nozzle disclosed in U.S. Pat. No. 5,134,347 transduced ultrasonic oscillations from an ultrasonic generator into ultra-high frequency mechanical vibrations capable of imparting thousands of pulses per second to the waterjet as it travels through the nozzle. The waterjet pulses impart a waterhammer pressure onto the surface to be cut or cleaned. Because of this rapid bombardment of mini-slugs of water, each imparting a waterhammer pressure on the target surface, the erosive capacity of the waterjet is tremendously enhanced. The ultrasonically pulsating nozzle cuts or cleans is thus able to cut or clean much more efficiently than the prior-art continuous-flow waterjets.

Theoretically, the erosive pressure striking the target surface is the stagnation pressure, or $\frac{1}{2}\rho v^2$ (where $\rho$ represents the water density and v represents the impact velocity of the water as it impinges on the target surface). The pressure arising due to the waterhammer phenomenon, by contrast, is $\rho c v$ (where c represents the speed of sound in water, which is approximately 1524 m/s). Thus, the theoretical magnification of impact pressure achieved by pulsating the waterjet is 2 c/v. Even if air drag neglected and the impact velocity is assumed to approximate the fluid discharge velocity of 1500 feet per second (or approximately 465 m/s), the magnification of impact pressure is about 6 to 7. If the model takes into account air drag and the impact velocity is about 300 m/s, then the theoretical magnification would be tenfold.

In practice, due to frictional losses and other inefficiencies, the pulsating ultrasonic nozzle described in U.S. Pat. No. 5,154,347 imparts about 6 to 8 times more impact pressure onto the target surface for a given source pressure. Therefore, to achieve the same erosive capacity, the pulsating nozzle need only operate with a pressure source that is 6 to 8 times less powerful. Since the pulsating nozzle may be used with a much smaller and less expensive pump, it is more economical than continuous-flow waterjet nozzles. Further, since waterjet pressure in the nozzle, lines, and fittings is much less with an ultrasonic nozzle, the ultrasonic nozzle can be designed to be lighter, less cumbersome and more cost-effective.

Although the ultrasonic nozzle described in U.S. Pat. No. 5,154,347 represented a substantial breakthrough in waterjet cutting and cleaning technology, further refinements and improvements were found by the Applicant to be desirable. The first iteration of the ultrasonic nozzle, which is described in U.S. Pat. No. 5,154,347, proved to be sub-optimal because it was used in conjunction with pre-existing waterjet generators. A need therefore arose for a complete ultrasonic waterjet apparatus which takes full advantage of the ultrasonic nozzle.

It also proved desirable to modify the ultrasonic nozzle to make it more efficient from a fluid-dynamic perspective, to be able to clean and remove coatings more efficiently from large surfaces, and to be more ergonomic in the hands of the end-user.

Accordingly, in light of the foregoing deficiencies, it would be highly desirable to provide an improved ultrasonic waterjet apparatus.

SUMMARY OF THE INVENTION

A main object of the present invention is to overcome at least some of the deficiencies of the above-noted prior art.

This object is achieved by the elements defined in the appended independent claims. Optional features and alternative embodiments are defined in the subsidiary claims.

Thus, an aspect of the present invention provides an ultrasonic waterjet apparatus including a generator module which has an ultrasonic generator for generating and transmitting high-frequency electrical pulses; a control unit for controlling the ultrasonic generator; a high-pressure water inlet connected to a source of high-pressure water; and a high-pressure water outlet connected to the high-pressure water inlet. The ultrasonic waterjet apparatus further includes a high-pressure water hose connected to the high-pressure water outlet and a gun connected to the high-pressure water hose. The gun has an ultrasonic nozzle having a transducer for receiving the high-frequency electrical pulses from the ultrasonic generator, the transducer converting the electrical pulses into vibrations that pulsate a waterjet flowing through the nozzle, creating a waterjet of pulsed slugs of water, each slug of water capable of imparting a waterhammer pressure on a target surface.

Preferably, the transducer is piezoelectric or piezomagnetic and is shaped as a cylindrical or tubular core.

Preferably, the gun is hand-held and further includes a trigger for activating the ultrasonic generator whereby a continuous-flow waterjet is transformed into a pulsated waterjet. The gun also includes a dump valve trigger for opening a dump valve located in the generator module.

Preferably, the ultrasonic waterjet apparatus has a compressed air hose for cooling the transducer and an ultrasonic signal cable for relaying the electrical pulses from the ultrasonic generator to the transducer.

For cleaning or de-coating large surfaces, the ultrasonic waterjet apparatus includes a rotating nozzle head or a nozzle with multiple exit orifices. The rotating nozzle head is preferably self-rotated by the torque generated by a pair of outer jets or by angled orifices.

An advantage of the present invention is that the ultrasonic waterjet apparatus generates a much higher effective impact pressure than continuous-flow waterjets, thus augmenting the apparatus' capacity to clean, cut, deburr, de-coat and break. By pulsating the waterjet, a train of mini slugs of water impact the target surface, each slug imparting a waterhammer pressure. For a given pressure source, the waterhammer pressure is much higher than the stagnation pressure of a continuous-flow waterjet. Therefore, the ultrasonic waterjet apparatus can operate with a much lower source pressure in order to cut and deburr, to clean and remove coatings, and to break rocks and rock-like substances. The ultrasonic waterjet apparatus is thus more efficient, more robust, and less expensive to construct and utilize than conventional continuous-flow waterjet systems.

Another aspect of the present invention provides an ultrasonic nozzle for use in an ultrasonic waterjet apparatus. The ultrasonic nozzle includes a transducer for converting high-frequency electrical pulses into mechanical vibrations that pulsate a waterjet flowing through the nozzle, creating a waterjet of pulsed slugs of water, each slug of water capable of imparting a waterhammer pressure on a target surface. The nozzle has a rotating nozzle head or multiple exit orifices for cleaning or de-coating large surfaces.

Another aspect of the present invention provides an ultrasonic nozzle for use in an ultrasonic waterjet apparatus including a transducer for converting high-frequency electrical pulses into mechanical vibrations that pulsate a waterjet flowing through the nozzle, creating a waterjet of pulsed slugs of water, each slug of water capable of imparting a waterhammer pressure on a target surface, the transducer having a microtip with a seal for isolating the transducer from the waterjet, the seal being located at a nodal plane where the amplitude of standing waves set up along the microtip is zero.

Another aspect of the present invention provides related methods of cutting, cleaning, deburring, de-coating and breaking rock-like materials with an ultrasonically pulsed waterjet. The method includes the steps of forcing a high-pressure continuous-flow waterjet through a nozzle; generating high-frequency electrical pulses; transmitting the high-frequency electrical pulses to a transducer; transducing the high-frequency electrical pulses into mechanical vibrations; pulsating the high-pressure continuous flow waterjet to transform it into a pulsated waterjet of discrete water slugs, each water slug capable of imparting a waterhammer pressure on a target surface; and directing the pulsated waterjet onto a target material. Depending on the desired application, the ultrasonically pulsed waterjet can be used to cut, clean, de-burr, de-coat or break.

Where the application is cleaning or de-coating a large surface, the ultrasonic waterjet apparatus advantageously includes a nozzle with multiple exit orifices or with a rotating nozzle head.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

Figure 1:
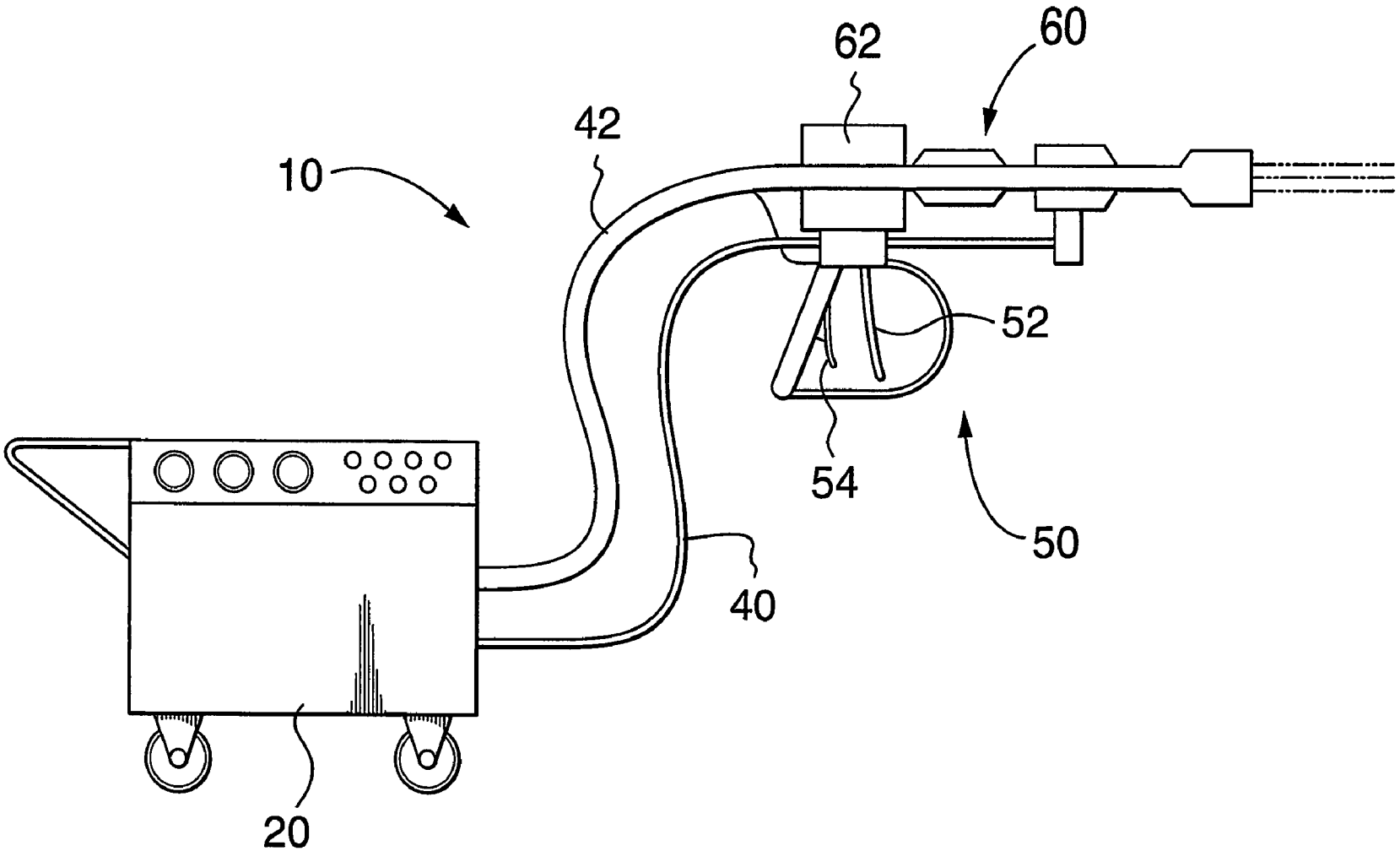
FIG. 1 is a schematic side view of an ultrasonic waterjet apparatus having a mobile generator module connected to a hand-held gun in accordance with an embodiment of the present invention.

FIG. 1 illustrates an ultrasonic waterjet apparatus in accordance with an embodiment of the present invention. The ultrasonic waterjet apparatus, which is designated generally by the reference numeral 10, has a mobile generator module 20 (also known as a forced pulsed waterjet generator). The mobile generator module 20 is connected via a high-pressure water hose 40, a compressed air hose 42, an ultrasonic signal cable 44, and a trigger signal cable 46 to a hand-held gun 50. The high-pressure water hose 40 and the compressed air hose 42 are sheathed in an abrasion-resistant nylon sleeve. The ultrasonic signal cable 44 is contained within the compressed air hose 42 for safety reasons. The compressed air is used to cool a transducer, which will be introduced and described below.

The hand-held gun 50 has a pulsing trigger 52 and a dump valve trigger 54. The hand-held gun also has an ultrasonic nozzle 60. The ultrasonic nozzle 60 has a transducer 62 which is either a piezoelectric transducer or a piezomagnetic transducer. The piezomagnetic transducer is made of a magnetostrictive material such as a Terfenol™ alloy.

Figure 2:
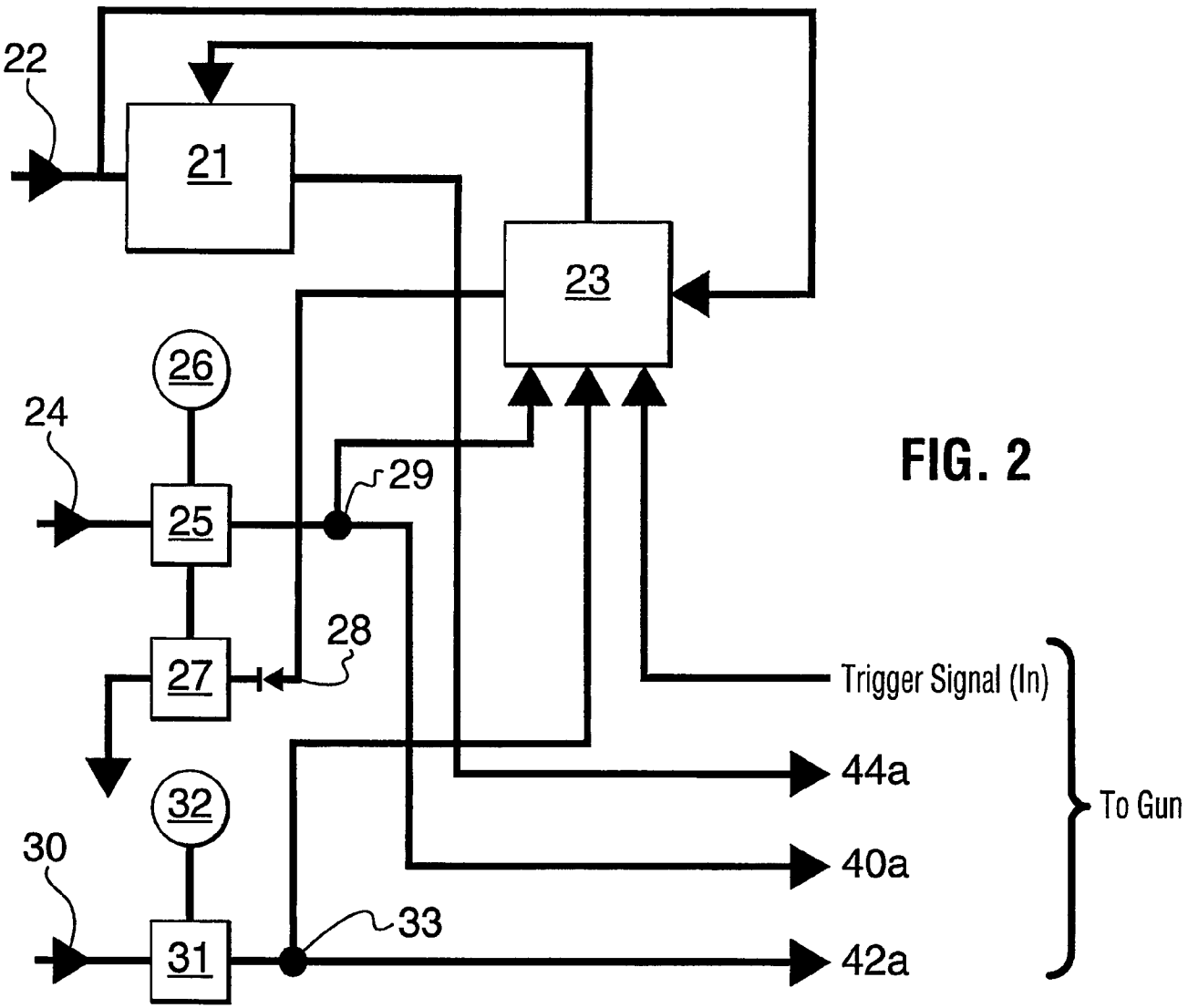
FIG. 2 is a schematic flow-chart illustrating the functioning of the mobile generator module.

As illustrated in FIG. 2, the mobile generator module 20 has an ultrasonic generator 21 which generates high-frequency electrical pulses, typically in the order of 20 kHz. The ultrasonic generator 21 is powered by an electrical power input 22 and controlled by a control unit 23 (which is also powered by the electrical power input, preferably a 220-V source). The mobile generator module also has a high-pressure water inlet 24 which is connected to a source of high-pressure water (not illustrated but known in the art). The high-pressure water inlet is connected to a high-pressure water manifold 25. A high-pressure water gage 26 connected to the high-pressure water manifold 25 is used to measure water pressure. A dump valve 27 is also connected to the high-pressure water manifold. The dump valve 27 is actuated by a solenoid 28 which is controlled by the control unit 23. The dump valve is located on the mobile generator module 20, instead of on the gun, in order to lighten the gun and to reduce the effect of jerky forces on the user when the dump valve is triggered. Finally, a high-pressure water pressure and switch 29 provides a feedback signal to the control unit.

Still referring to FIG. 2, the mobile generator module 20 also has an air inlet 30 for admitting compressed air from a source of compressed air (not shown, but known in the art). The air inlet 30 connects to an air manifold 31, an air gage 32 and an air-pressure sensor and switch 33 for providing a feedback signal to the control unit. The control unit also receives a trigger signal through the trigger signal cable 46. The control unit 23 of the mobile generator module 20 is designed to not only ensure the safety of the operator but also to protect the sensitive components of the apparatus. For instance, if there is no airflow through the transducer, and water flow through the gun, then it is not possible to turn on the ultrasonic generator.

As shown in FIG. 2, the mobile generator module 20 has a high-pressure water outlet 40*a*, a compressed air outlet 42*a* and an ultrasonic signal output 44*a* which are connected to the hand-held gun 50 via the high-pressure water hose 40, the compressed air hose 42 and the ultrasonic signal cable 44, respectively.

Figure 3:
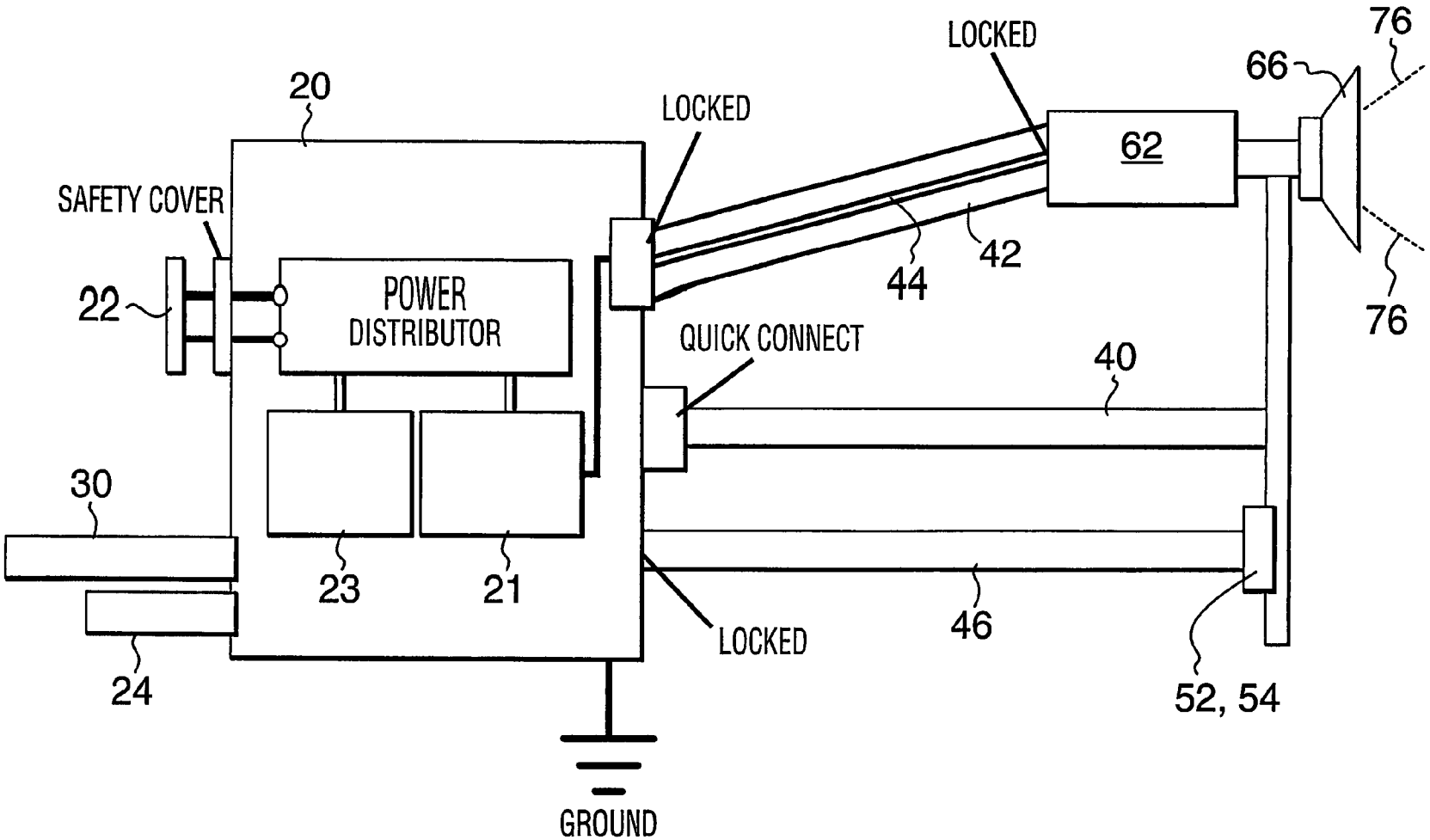
FIG. 3 is a schematic showing the functioning of the ultrasonic waterjet apparatus.

FIG. 3 is a schematic diagram of the wiring and cabling of the ultrasonic waterjet apparatus 10. The compressed air hose is rated for 100 psi and carries within it the ultrasonic signal cable which is rated to transmit high-frequency 3.5 kV pulses. The air hose and ultrasonic signal cable are plugged connects with the transducer in the gun. The high-pressure water hose is rated to a maximum of 20,000 psi and is connected to the gun but downstream of the transducer as shown. The trigger signal cable, designed to carry 27 VAC, 0.7 A signals, links the trigger and the generator module.

As shown in FIG. 3, the ultrasonic waterjet apparatus 10 has several safety features. All the electrical receptacles are either spring-loaded or locked with nuts. As mentioned earlier, the water and air hoses are sheathed in abrasion-resistant nylon to withstand wear and tear. Further, in the unlikely event that an air hose is severed by accidental exposure to the waterjet, the voltage in the ultrasonic signal cable is reduced instantaneously to zero by the air pressure sensor and switch.

Figure 4:
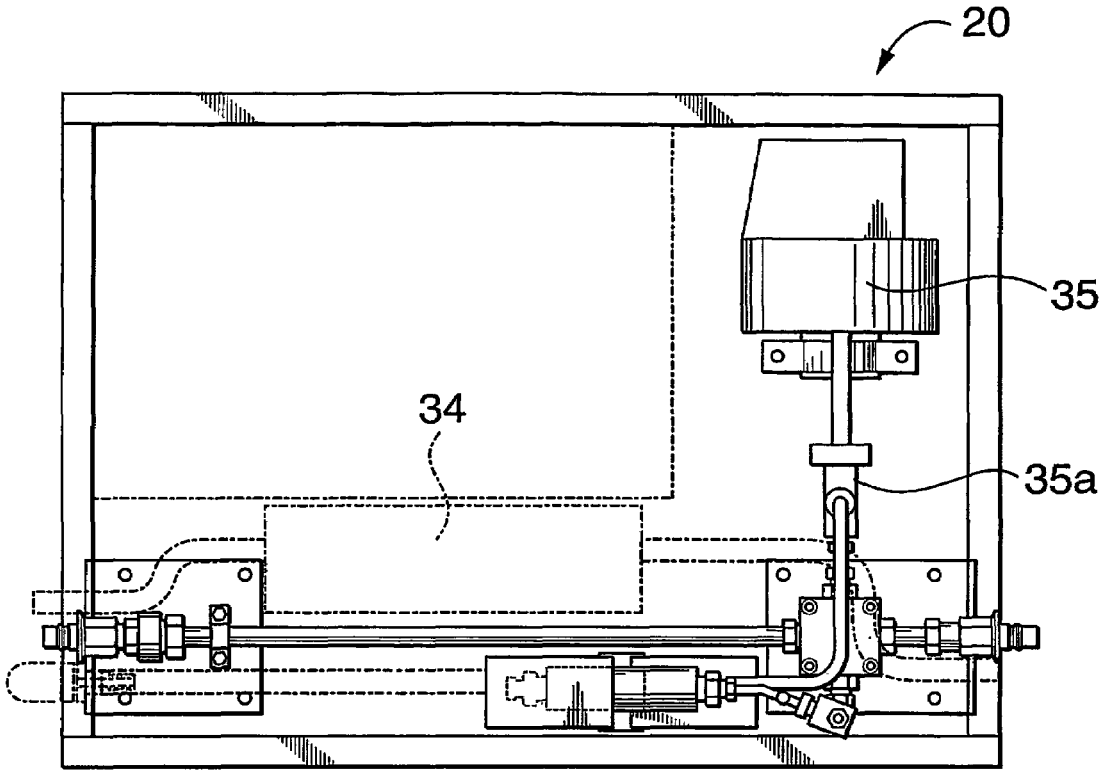
FIG. 4 is a top plan view of the mobile generator module.
Figure 5:
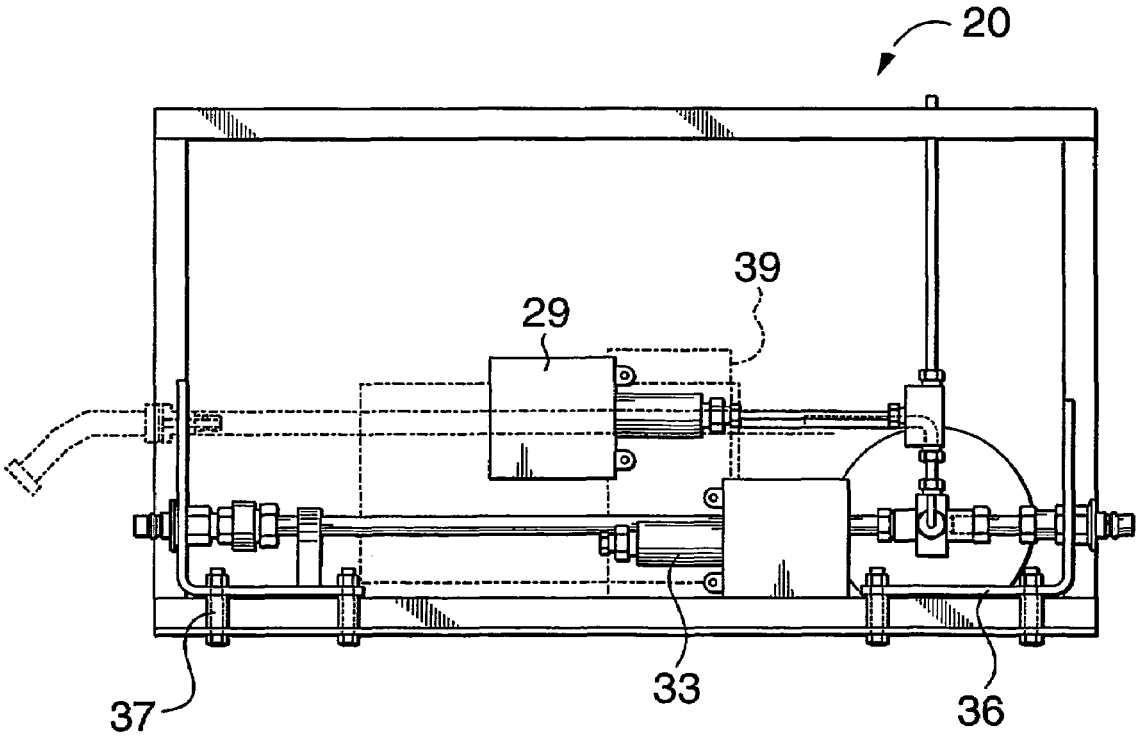
FIG. 5 is a rear elevational view of the mobile generator module.
Figure 6:
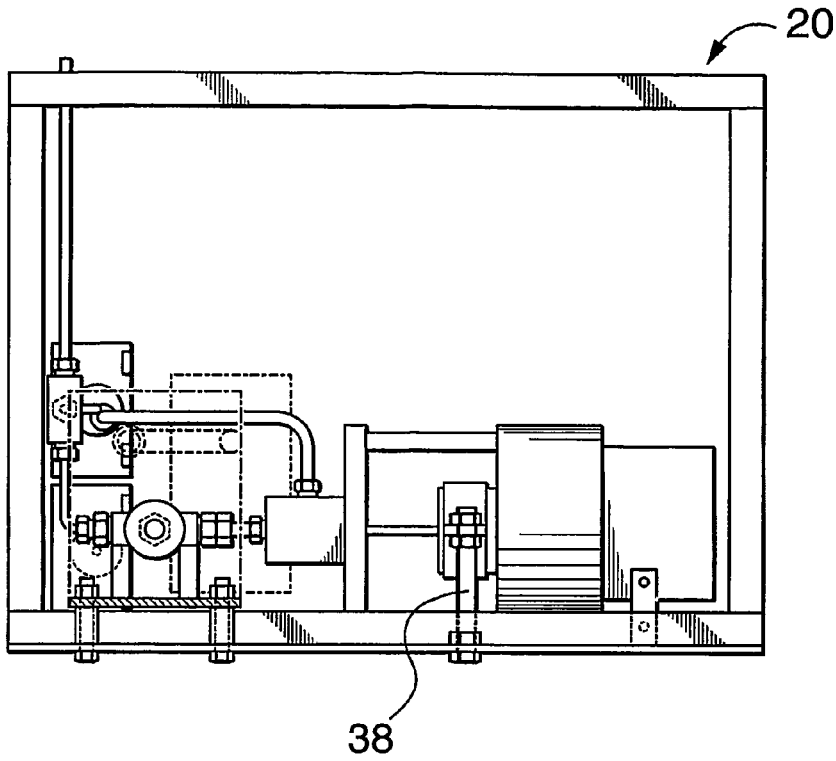
FIG. 6 is a left side elevational view of the mobile generator module.

FIGS. 4, 5 and 6 are detailed assembly drawings of the mobile generator module 20 showing its various components. The mobile generator module 20 has an air filter assembly 34 for protecting the transducer from dust, oil and dirt. The solenoid 28 is coupled to a pneumatic actuator assembly 35 for actuating the dump valve. The pneumatic actuator assembly includes a pneumatic valve 35*a*, an air cylinder 35*b*, an air cylinder inlet valve 35*c*, an air cylinder outlet valve 35*d*. The mobile generator module 20 further includes a water/air inlet bracket 36, a water/air outlet bracket 37, a pipe hanger 38, the water pressure switch 29, the air pressure switch 33 and a water/air pressure switches bracket 39.

Figure 7:
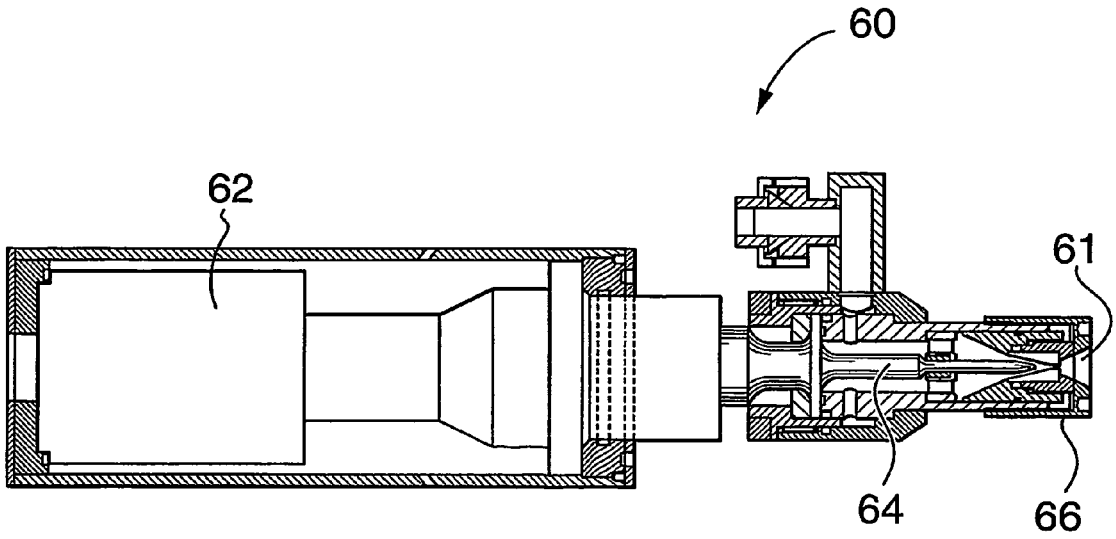
FIG. 7 is a cross-sectional view of an ultrasonic nozzle having a piezoelectric transducer for use in the ultrasonic waterjet apparatus.

With reference to FIG. 7, the ultrasonic nozzle 60 of the ultrasonic waterjet apparatus 10 uses a piezoelectric transducer or a piezomagnetic (magnetostrictive) transducer 62 which is connected to a microtip 64, or, "velocity transformer", to modulate, or pulsate, a continuous-flow waterjet exiting a nozzle head 66, thereby transforming the continuous-flow waterjet into a pulsated waterjet. The ultrasonic nozzle 60 forms what is known in the art as a "forced pulsed waterjet", or a pulsated waterjet. The pulsated waterjet is a stream, or train, of water packets or water slugs, each imparting a waterhammer pressure on a target surface. Because the waterhammer pressure is significantly greater than the stagnation pressure of a continuous-flow waterjet, the pulsated waterjet is much more efficient at cutting, cleaning, de-burring, de-coating and breaking.

Figure 8:
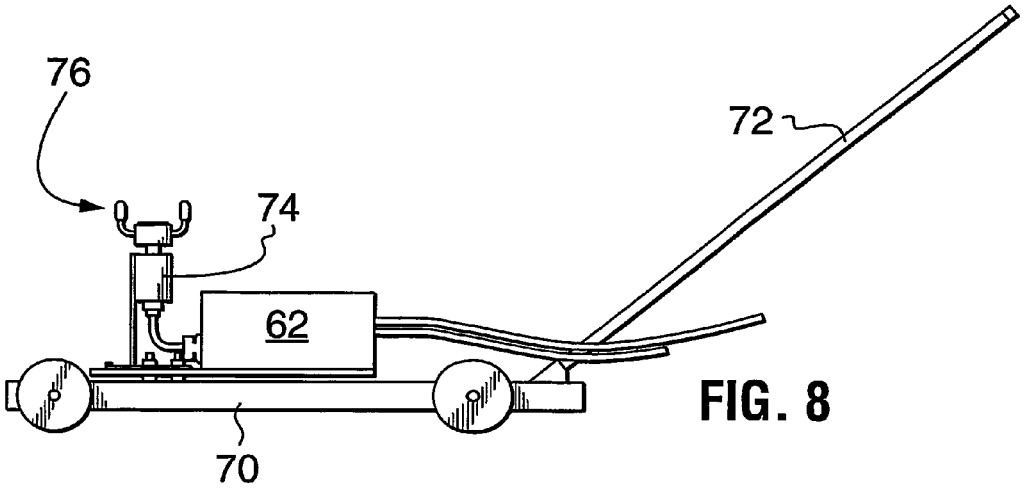
FIG. 8 is a side elevational view of the ultrasonic nozzle mounted to a wheeled base for use in cleaning or decontaminating the underside of a vehicle.

The ultrasonic nozzle may be fitted onto a hand-held gun as shown in FIG. 1 or may be installed on a computer-controlled X-Y gantry (for precision cutting or machining operations). The ultrasonic nozzle may also be fitted onto a wheeled base 70 as shown in FIG. 8. The wheeled base 70 has a handle 72 and a swivel 74 and twin rotating orifices 76. The wheeled base of FIG. 8 can be used for cleaning or decontaminating the underside of a vehicle.

Figure 9:
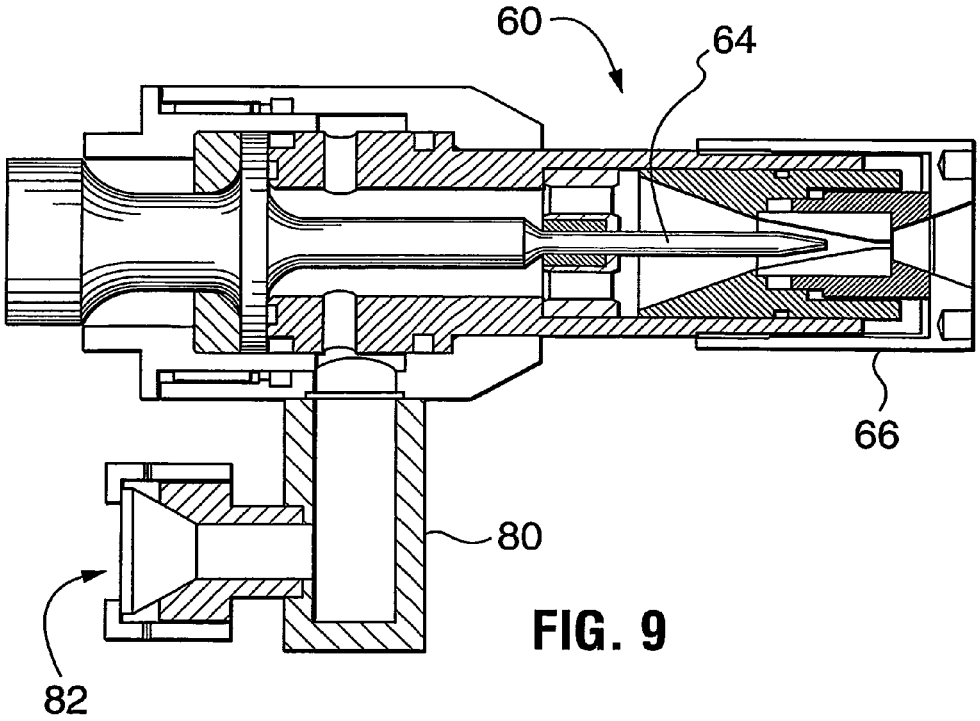
FIG. 9 is a cross-sectional view of an ultrasonic nozzle showing the details of a side port for water intake and the disposition of a microtip for modulating the waterjet.

The continuous-flow waterjet enters through a water inlet downstream of the transducer as shown in FIG. 7. As shown in FIG. 7 and FIG. 9, the water enters the ultrasonic nozzle 60 though a side port 80 which is in fluid communication with a water inlet 82. The water does not directly impinge on the slender end of the microtip 64, which is important because this obviates the setting up of deleterious transverse oscillations of the microtip. Transverse oscillations of the microtip disrupt the waterjet and may lead to fracture of the microtip.

Figure 10:
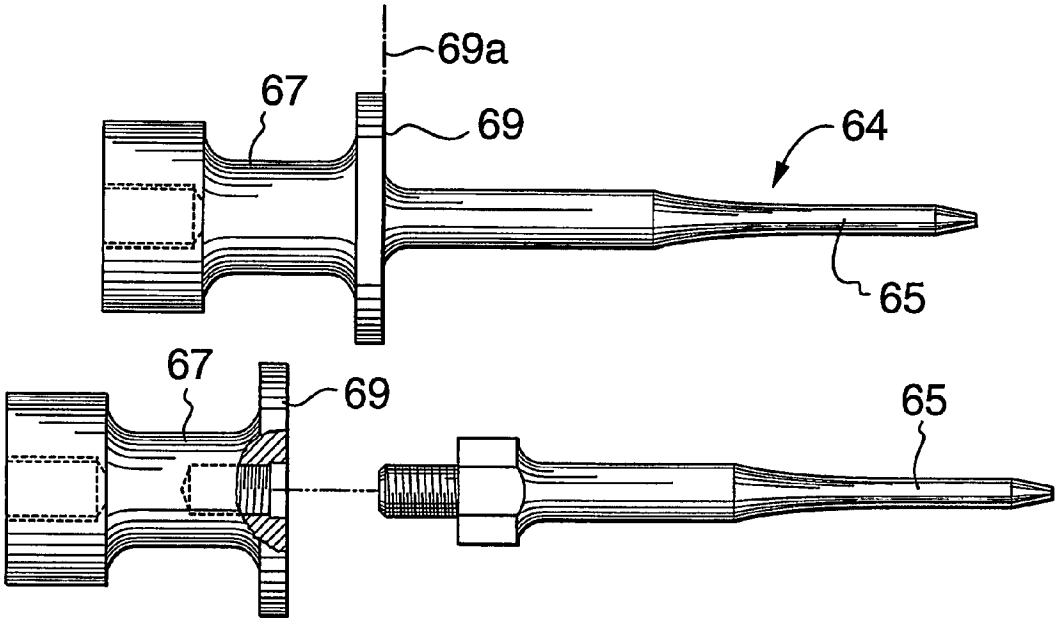
FIG. 10 is a side elevational view of a microtip in having the form of a stepped cylinder.

Although the microtip may be shaped in a variety of manners (conical, exponential, etc.), the preferred profile of the microtip is that of a stepped cylinder, as shown in FIG. 10, which is simple to manufacture, durable and offers good fluid dynamics. The microtip 64 is preferably made of a titanium alloy. Titanium alloy is used because of its high sonic speed and because it offers maximum amplitude of oscillations of the tip. As shown in FIG. 10, the microtip 64 has a stub 67 and a stem 65. The stub 67 is female-threaded for connection to the transducer. The stem 65 is slender and located downstream so that it may contact and modulate the waterjet. Also shown in FIG. 10 is a flange 69 located between the stub 67 and the stem 65. The flange 69 defines a nodal plane 69*a*. As the sound waves travel downstream (from left to right in the FIG. 10), and are reflected at the tip, a pattern of standing waves are set up in the microtip 64. At the nodal plane 69*a*, the amplitude of the standing waves is zero and therefore this is the optimum location for placing an O-ring (not shown) for sealing the high-pressure water. The O-ring is hard-rated at 85-durometer or higher.

Figure 11:
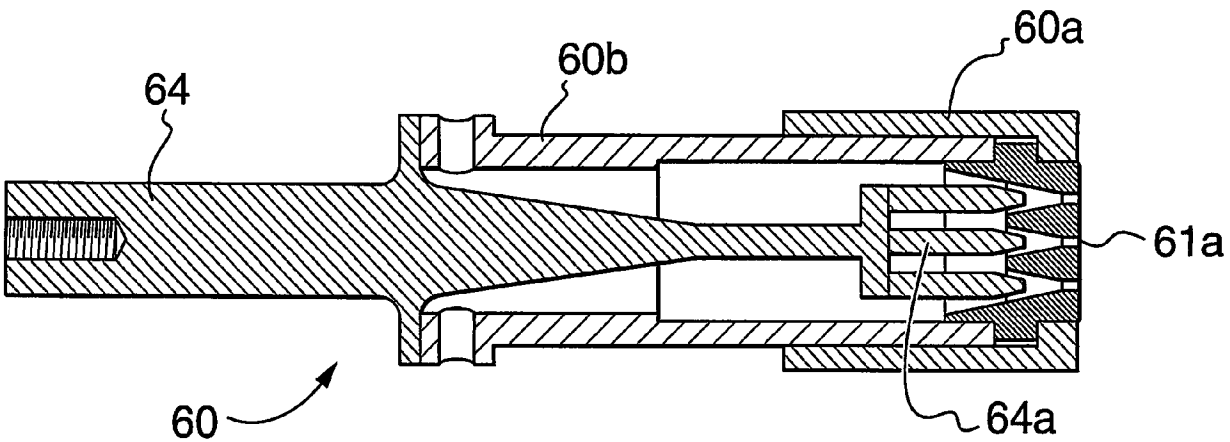
FIG. 11 is a cross-sectional view of a multiple-orifice nozzle for use in a second embodiment of the ultrasonic waterjet apparatus.

As shown in FIG. 7, the ultrasonic nozzle 60 has a single orifice 61. A single orifice is useful for many applications such as cutting and deburring various materials as well as breaking rock-like materials. However, for applications such as cleaning or de-coating large surface areas, a single orifice only removes a narrow swath per pass. Therefore, for applications such as cleaning and removing coatings such as paint, enamel, or rust, it is useful to provide a second embodiment in which the ultrasonic nozzle has a plurality of orifices. An ultrasonic nozzle 60 with three orifices 61*a* is shown in FIG. 11. The microtip has three prongs for modulating the waterjet as it is forced through the three parallel exit orifices. The triple-orifice nozzle of FIG. 11 is thus able to clean or de-coat a wider swath than a single-orifice nozzle. As shown in FIG. 11, a nut 60*a* secures the multiple-orifice nozzle to a housing 60*b*. FIG. 11 shows how the microtip 64 culminates in three prongs 64*a*, one for each of the three orifices 61*a*.

Figure 12:
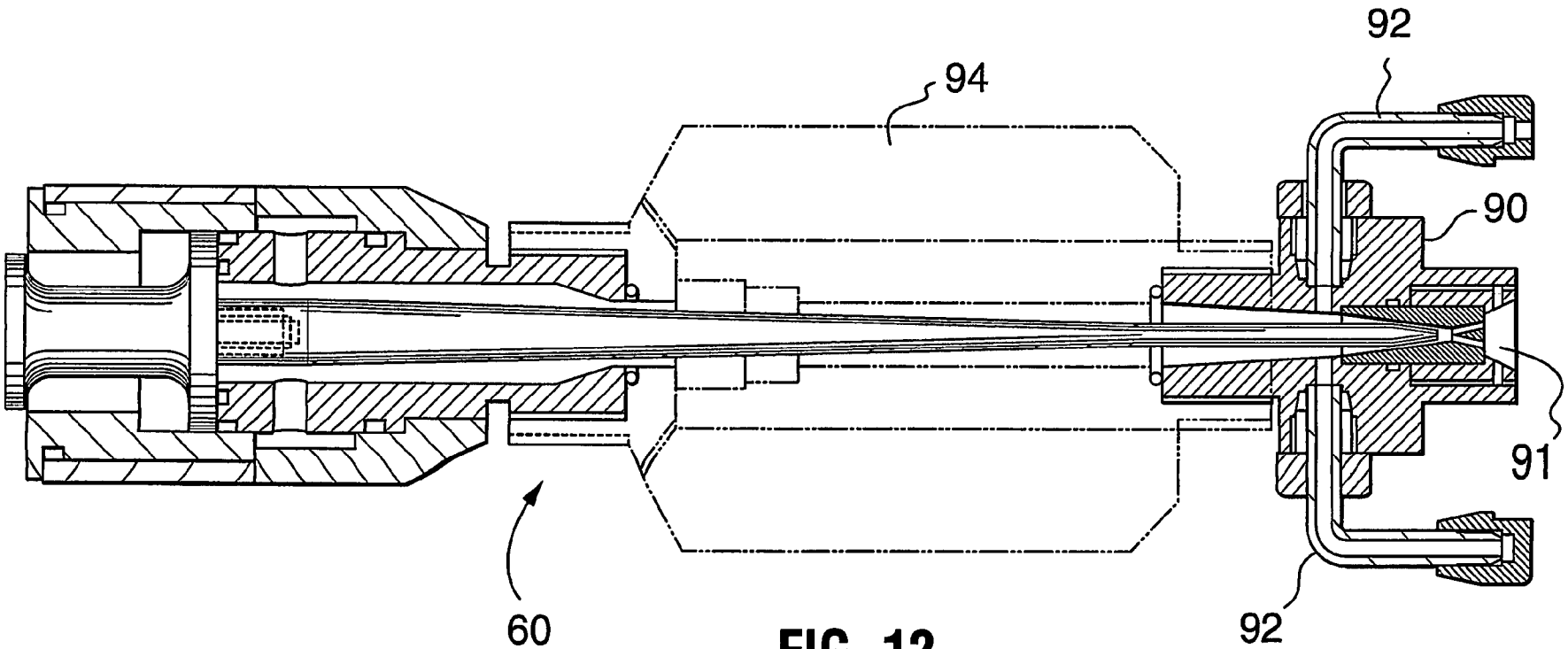
FIG. 12 is a schematic cross-sectional view of a third embodiment of the ultrasonic waterjet apparatus having a rotating nozzle head which is rotated by the torque generated by two outer jets.

In a third embodiment, which is illustrated in FIG. 12, the ultrasonic nozzle 60 has a rotating nozzle head 90 which permits the ultrasonic nozzle 60 to efficiently clean or de-coat a large surface area. The rotating nozzle head 90 is self-rotating because water is bled off into two outer jets 92. The bled-off water generates torque which causes the outer jets 92 to rotate, which, in turn, cause the rotating nozzle head 90 to rotate. In this embodiment, the bulk of the waterjet is forced through one or two angled exit orifices 91. Depending on the material to be cleaned, the outer jets may or may not contribute to the cleaning process. An acoustically matching swivel 94 is interposed between the transducer and the rotating nozzle head. The swivel 94 is designed to not only withstand the pressure but also acoustically match the rest of the system to achieve resonance. The swivel 94 may or may not have a speed control mechanism, such as a rotational damper, for limiting the angular velocity of the rotating nozzle head.

Figure 13:
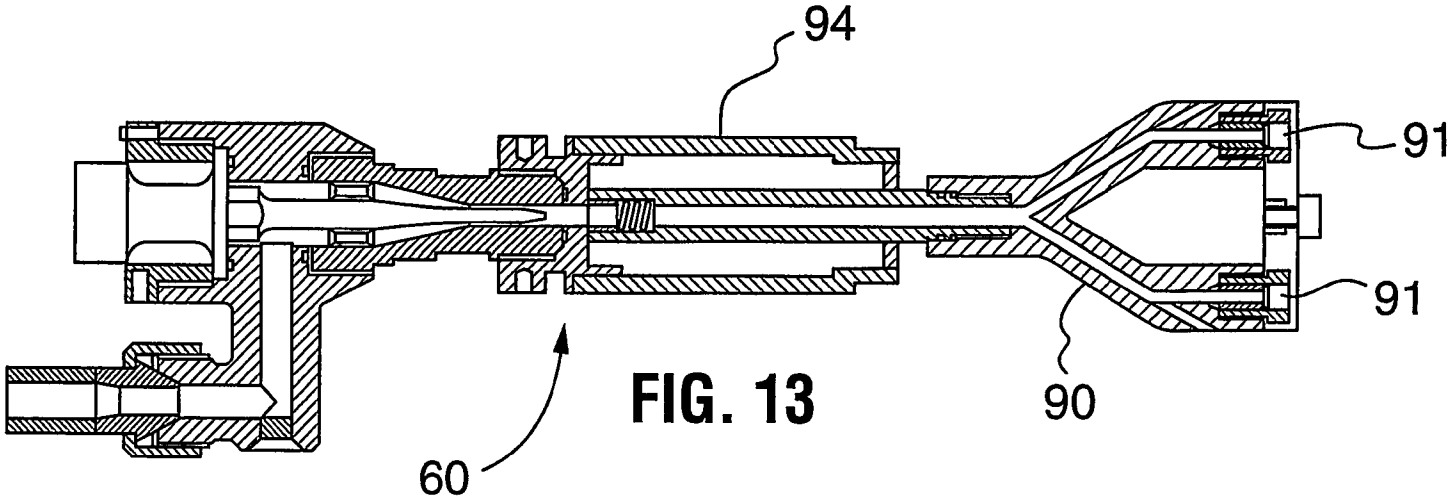
FIG. 13 is a cross-sectional view of a rotating ultrasonic nozzle having angled orifices.
Figure 14:
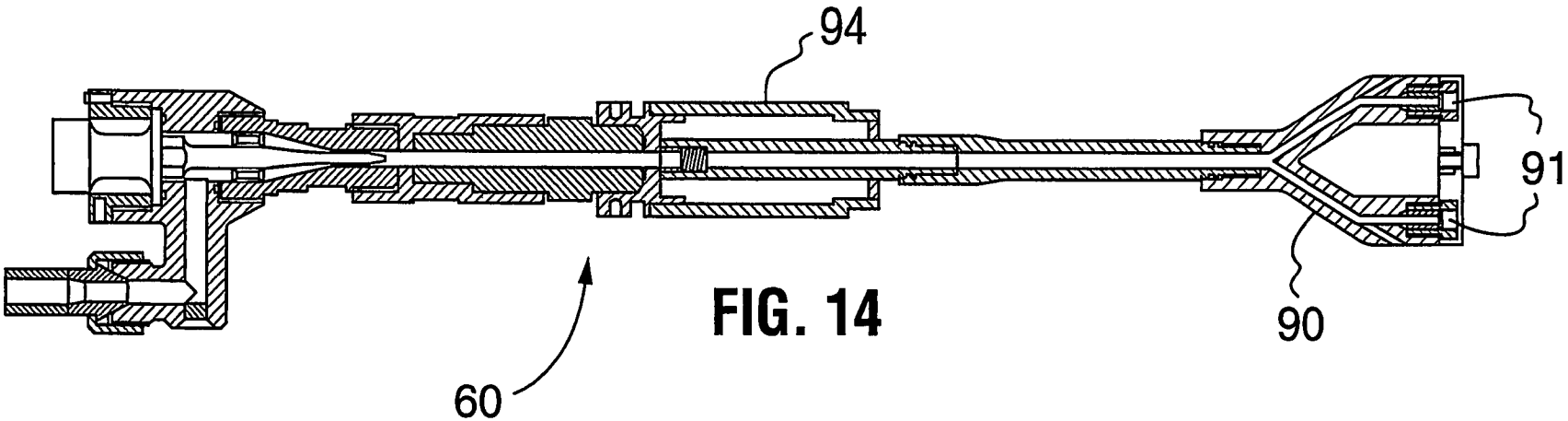
FIG. 14 is a cross-sectional view of a variant of the rotating ultrasonic nozzle of FIG. 13.
Figure 15:
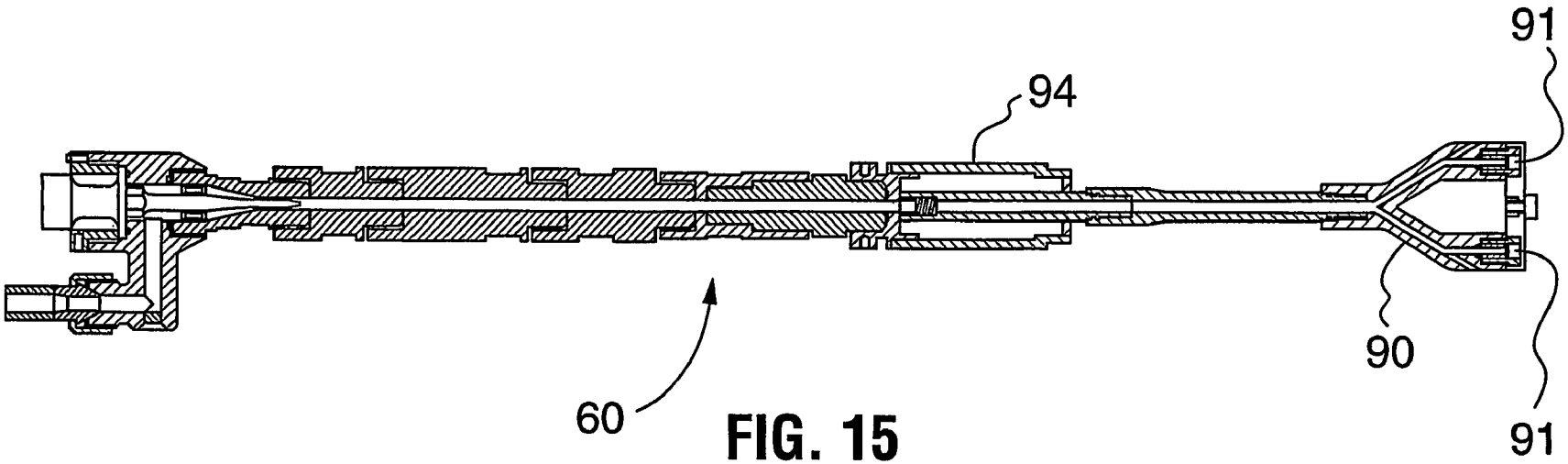
FIG. 15 is a cross-sectional view of another variant of the rotating ultrasonic nozzle of FIG. 13.

As shown in FIGS. 13, 14, and 15, self-rotation of the rotating nozzle head 90 may be achieved by varying the angle of orientation of the exit orifices 91. As the waterjet is forced out of the exit orifices, a torque is generated which causes the rotating nozzle head 90 to rotate. A rotational damper in the swivel 94 may be installed to limit the angular velocity of the rotating nozzle head 90. The configurations shown in FIGS. 13, 14 and 15 are particularly useful in confined spaces. For cleaning and de-coating large surfaces, it is also possible to use a single oscillating nozzle.

Figure 16:
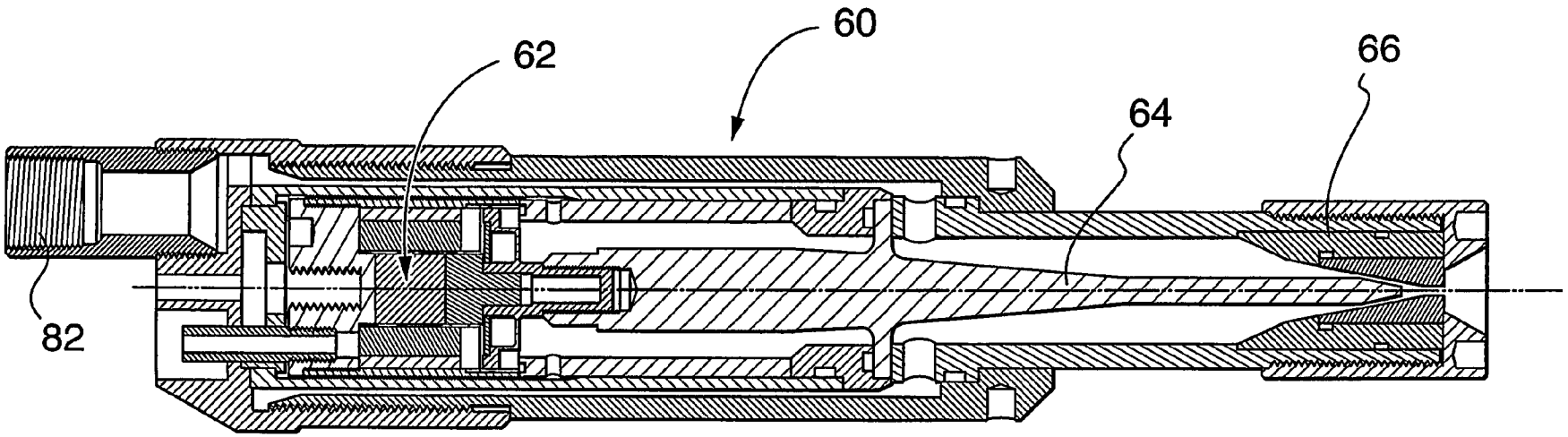
FIG. 16 is a cross-sectional view of an ultrasonic nozzle having an embedded magnetostrictive transducer.
Figure 17:
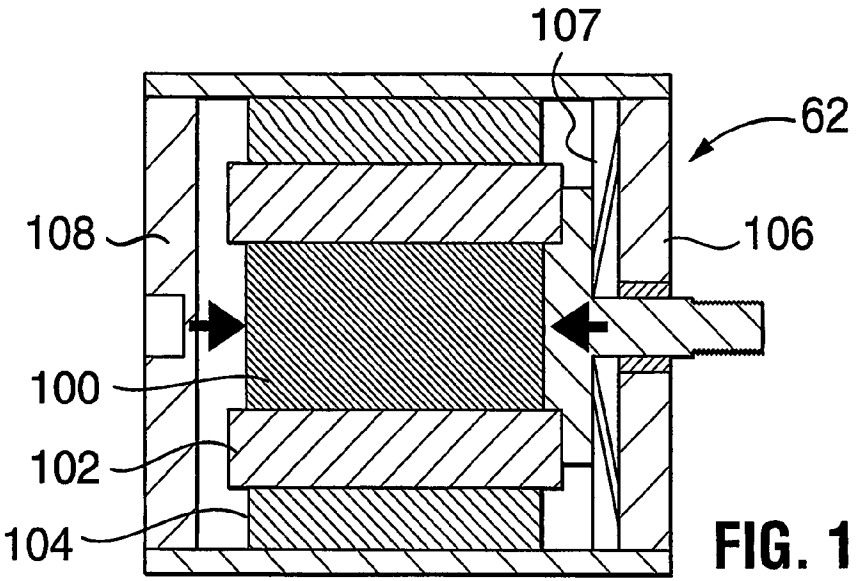
FIG. 17 is a schematic cross-sectional view of a magnetostrictive transducer in the form of cylindrical core.

For underwater operations, the piezomagnetic, transducer is used rather than the piezoelectric which cannot be immersed in water. The piezomagnetic transducer 62 can be packaged inside the nozzle 60 unlike the piezoelectric transducer. The piezomagnetic transducer uses a magnetostrictive material such as one of the commercially available alloys of Terfenol™. These Terfenol-based magnetostrictive transducers are compact and submergible in the nozzle 60 as shown in FIG. 16. Whereas the piezoelectric transducer produces mechanical oscillations in response to an applied oscillating electric field, the magnetostrictive material produces mechanical oscillations in response to an applied magnetic field (by a coil and bias magnet as shown in FIG. 17). However, for reliable operation, it is important to keep the magnetostrictive material below the Curie temperature and always under compression. While the compressive stress can be applied by the end plates shown in FIG. 17, cooling it to keep the temperature below the Curie point, particularly for the uses described herein, requires one of several different techniques, depending on the application.

FIG. 17 shows one assembly configuration for a magnetostrictive transducer 62. A Terfenol™ alloy is used as a magnetostrictive core 100. The core 100 is surrounded concentrically by a coil 102 and a bias magnet 104 as shown. A loading plate 106, a spring 107 and an end plate 108 keep the assembly in compression.

For short-duration applications, which do not require rotating nozzle heads, the configuration shown in FIG. 16 is adequate. In this configuration, the transducer is cooled by airflow just as in the case of a piezoelectric transducer (e.g. by compressed air being forced over the transducer).

Figure 18:
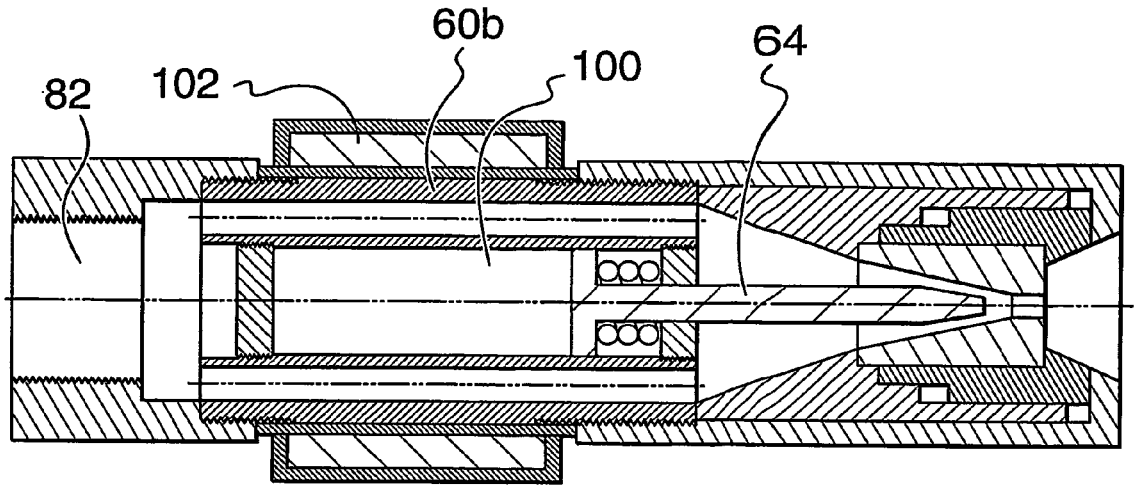
FIG. 18 is a cross-sectional view of an ultrasonic nozzle with a magnetostrictive cylindrical core.
Figure 19:
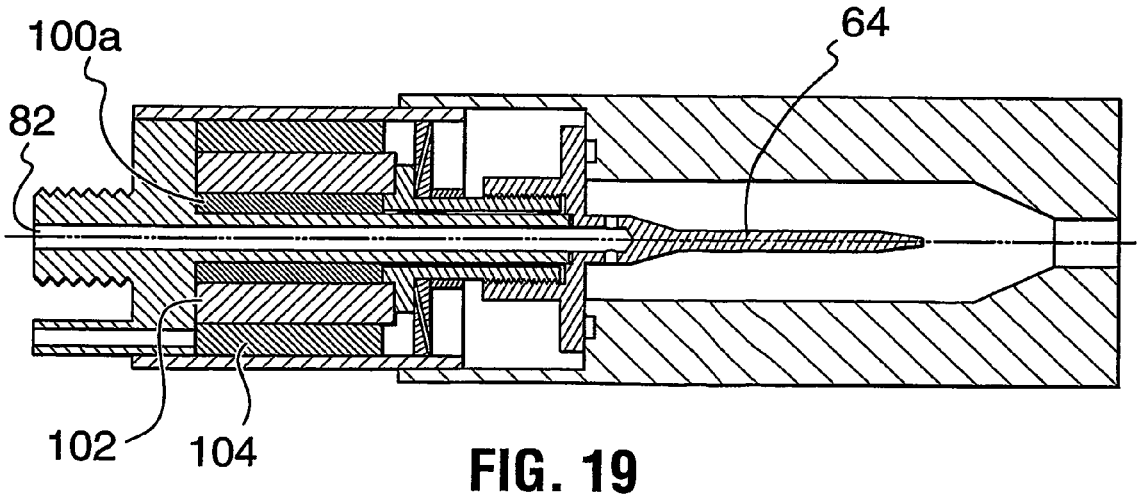
FIG. 19 is a cross-sectional view of an ultrasonic nozzle with a magnetostrictive tubular core.

For long period of operation, or for operating in a rotating configuration, this type of airflow cooling is not a viable solution. The configurations shown in FIGS. 18, 19, 20 and 21 can be adopted for any demanding situation. As illustrated in FIG. 18, the Terfenol rod is cooled by high-pressure water flowing through an annular passage. As illustrated in FIG. 19, on the other hand, a Terfenol is shaped as a tube 100*a* to further enhance cooling. The Terfenol tube is placed within the coil 102 and bias magnet 104, as before. The configurations shown in FIGS. 18 and 19 can be used for non-rotating multiple-orifice configurations.

Figure 20:
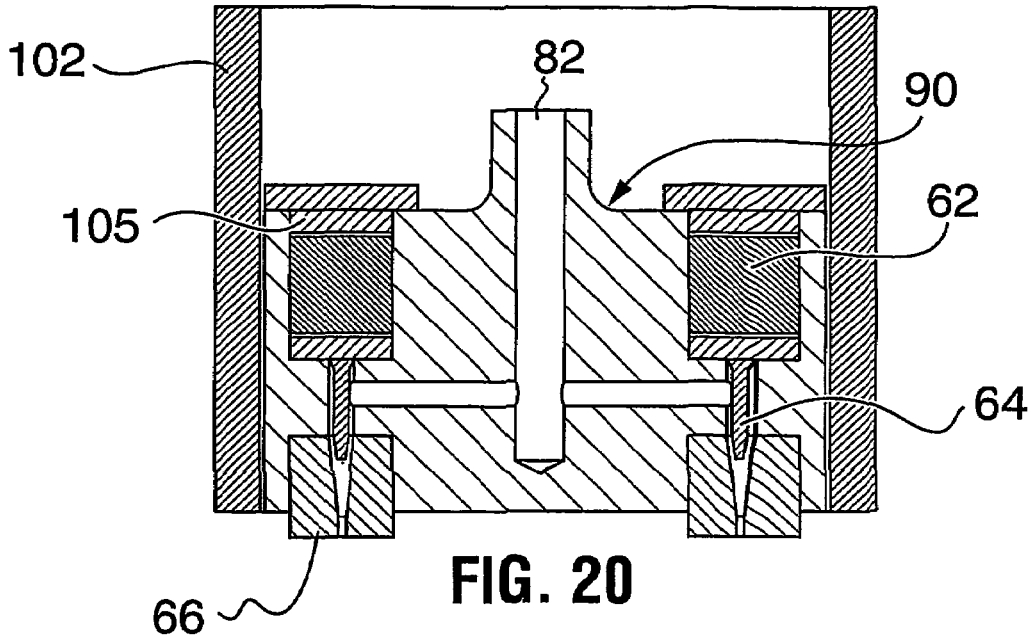
FIG. 20 is a schematic cross-sectional view of a rotating twin-orifice nozzle with a stationary coil.
Figure 21:
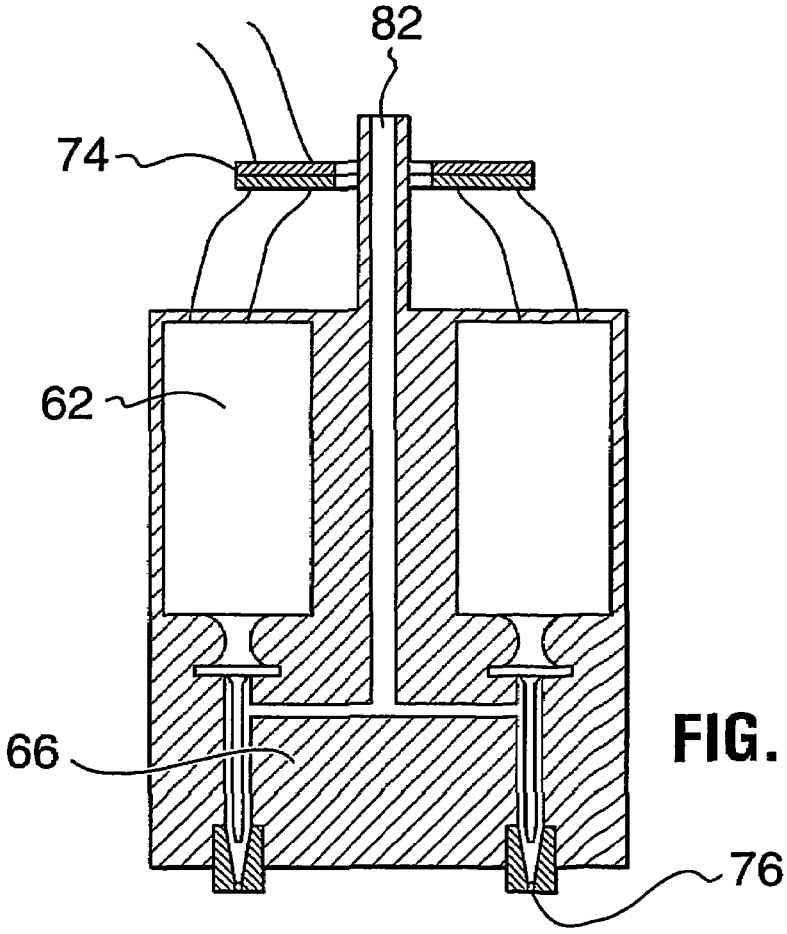
FIG. 21 is a schematic cross-sectional view of a rotating twin-orifice nozzle with a swivel.

For rotating nozzle heads incorporating two or more orifices, the configurations illustrated in FIGS. 20 and 21 are more suitable. As shown in FIGS. 20 and 21, high-pressure water is forced through an inlet 82, pulsated and then ejected through two exit orifices 76. Each exit orifice has its own microtip 64, or "probe", that is vibrated by the magnetostrictive transducer 62. In FIG. 20, the nozzle head 66 is rotated while the coil 102 remains stationary. In FIG. 21, the nozzle is rotated using a swivel 74 as described earlier. As a result, the pulsed waterjet is split into two jets for efficiently cleaning or de-coating a large surface area.

The embodiment(s) of the invention described above is (are) intended to be exemplary only. The scope of the invention is therefore intended to be limited solely by the scope of the appended claims.

The invention claimed is:

1. An ultrasonic waterjet apparatus comprising: a) a generator module having: i) an ultrasonic generator for generating and transmitting high-frequency electrical pulses; ii) a control unit for controlling the ultrasonic generator; iii) a high-pressure water inlet connected to a source of high-pressure water; iv) a high-pressure water outlet connected to the high-pressure water inlet; b) a high-pressure water hose connected to the high-pressure water outlet; c) a gun connected to the high-pressure water hose, the gun having an ultrasonic nozzle having a transducer for receiving the high-frequency electrical pulses from the ultrasonic generator, the transducer converting the electrical pulses into vibrations that pulsate a waterjet flowing through the nozzle, creating a waterjet of pulsed slugs of water, each slug of water capable of imparting a waterhammer pressure on a target surface, wherein the generator module further comprises a water dump valve between the high-pressure water inlet and the high-pressure water outlet and an actuator for opening and closing the water dump valve in response to a signal transmitted from a dump valve trigger located on the gun.

2. An ultrasonic waterjet apparatus as claimed in claim 1 wherein the actuator is a solenoid.

3. An ultrasonic waterjet apparatus as claimed in claim 1 further comprising an ultrasonic signal cable for relaying the electrical pulses from the ultrasonic generator to the transducer.

4. An ultrasonic waterjet apparatus as claimed in claim 1 further comprising a compressed air hose for providing compressed air to cool the transducer.

5. An ultrasonic waterjet apparatus as claimed in claim 4 wherein the ultrasonic signal cable is housed within the compressed air hose.

6. An ultrasonic waterjet apparatus as claimed in claim 4 wherein the generator module further comprises a compressed air inlet and a compressed air outlet, the compressed air outlet being connected to the compressed air hose.

7. An ultrasonic waterjet apparatus as claimed in claim 1 wherein the high-pressure water hose is sheathed in an abrasion-resistant nylon sleeve.

8. An ultrasonic waterjet apparatus as claimed in claim 1 wherein the ultrasonic nozzle has a single exit orifice.

9. An ultrasonic waterjet apparatus as claimed in claim 1 wherein the ultrasonic nozzle has a plurality of exit orifices.

10. An ultrasonic waterjet apparatus as claimed in claim 1 wherein the ultrasonic nozzle further comprises a rotating nozzle head.

11. An ultrasonic waterjet apparatus as claimed in claim 10 wherein the rotating nozzle head uses the water pressure in the nozzle to be self-rotating.

12. An ultrasonic waterjet apparatus as claimed in claim 11 wherein the ultrasonic nozzle further comprises a rotational damper to reduce the angular velocity of the rotating nozzle head.

13. An ultrasonic waterjet apparatus as claimed in claim 12 wherein the ultrasonic nozzle further comprises a pair of outer jets in fluid communication with the waterjet to provide torque to self-rotate the rotating nozzle head.

14. An ultrasonic waterjet apparatus as claimed in claim 13 comprising a single angled exit orifice.

15. An ultrasonic waterjet apparatus as claimed in claim 12 comprising a plurality of angled exit orifices.

16. An ultrasonic waterjet apparatus as claimed in claim 15 wherein the plurality of angled exit orifices generate torque to self-rotate the rotating nozzle head.

17. An ultrasonic waterjet apparatus comprising: a) a generator module having: i) an ultrasonic generator for generating and transmitting high-frequency electrical pulses; ii) a control unit for controlling the ultrasonic generator; iii) a high-pressure water inlet connected to a source of high-pressure water; iv) a high-pressure water outlet connected to the high-pressure water inlet; b) a high-pressure water hose connected to the high-pressure water outlet; c) a gun connected to the high-pressure water hose, the gun having an ultrasonic nozzle having a transducer for receiving the high-frequency electrical pulses from the ultrasonic generator, the transducer converting the electrical pulses into vibrations that pulsate a waterjet flowing through the nozzle, creating a waterjet of pulsed slugs of water, each slug of water capable of imparting a waterhammer pressure on a target surface wherein the transducer further comprises a microtip which acts as a velocity transformer by pulsing the waterjet, wherein the microtip comprises a stub for connecting to the transducer, a stem for contacting and modulating the waterjet, and a flange between the stub and the stem, the flange defining a nodal plane at which the amplitude of standing waves set up at the microtip is zero.

18. An ultrasonic waterjet apparatus as claimed in claim 17 wherein the microtip further comprises an O-ring seal at the nodal plane for isolating the transducer from the waterjet.

19. An ultrasonic waterjet apparatus as claimed in claim 18 wherein the O-ring has a hardness rating of at least 85 durometer.

20. An ultrasonic nozzle for use in an ultrasonic waterjet apparatus, the ultrasonic nozzle comprising a transducer for converting high-frequency electrical pulses into mechanical vibrations that pulsate a waterjet flowing through the nozzle, creating a waterjet of pulsed slugs of water, each slug of water capable of imparting a waterhammer pressure on a target surface, the transducer comprising a microtip with a seal for isolating the transducer from the waterjet, the seal being located at a nodal plane where the amplitude of standing waves set up along the microtip is zero.

21. An ultrasonic nozzle as claimed in claim 20 wherein the microtip is a stepped cylinder.

22. An ultrasonic nozzle as claimed in claim 21 wherein the microtip is made of a titanium alloy.

* * * * *